US005272411A

United States Patent [19]

Francisco et al.

[11] Patent Number: 5,272,411

[45] Date of Patent: Dec. 21, 1993

[54] COAXIAL TRIODE APPARATUS

[75] Inventors: Frank F. Francisco, Easton; Kenneth S. Karsten, Jr., Bethlehem, both of Pa.

[73] Assignee: ITT Corporation, New York, N.Y.

[21] Appl. No.: 827,598

[22] Filed: Jan. 28, 1992

[51] Int. Cl.[5] ..... H01J 1/46

[52] U.S. Cl. ..... 313/296; 313/306; 313/308

[58] Field of Search ..... 313/266, 296, 302, 304, 313/306, 307, 308, 309

[56] References Cited

U.S. PATENT DOCUMENTS 4,956,574 9/1990 Kane ..... 313/306

5,144,191 9/1992 Jones et al. ..... 313/308

*Primary Examiner*—Sandra L. O'Shea

*Attorney, Agent, or Firm*—Arthur L. Plevy; Patrick M. Hogan

[57] ABSTRACT

A triode having a coaxially positioned cathode and grid or gate electrode positioned within an evacuated tubular anode. The cathode has a plurality of emitting points radially disposed on its outer surface. The emitting points are surrounded by a plurality of grid or gate electrodes controlling the conducted beam current between the inner cathode and the surrounding anode. The gain and power of the triode is only limited by the number of emitter points and the number of grid or gate electrodes positioned within the anode. Since the anode envelopes the cathode and grid electrode, the anode can be used as a waveguide or antenna launch without the need of RF coupling connectors.

19 Claims, 4 Drawing Sheets

COAXIAL TRIODE APPARATUS

FIELD OF THE INVENTION

The present invention relates to microelectronic triodes, and particularly to such triodes having alternately stacked emitter electrode layers and gate electrode layers, formed by integrated circuit techniques.

BACKGROUND OF THE INVENTION

The vacuum tube triode has been in existence for quite some time, and during that time many improvements have been made which resulted in the reduction of the size of triodes. Smaller triodes use less power and can be used in more applications. Thus, the miniaturization of triodes is a highly desirable goal. The state of the art in miniaturized triodes today are vacuum microelectronic triodes fabricated by VLSI integrated circuit and/or micro-machining techniques. Such techniques miniaturize triodes to the integrated circuit level but still leave room for further miniaturization. In applications such as with active antenna arrays for the H, I, and J frequency bands, device sizes ar required that are less than 0.5 inch square by 5.0 inches in length. These size requirements include the space dedicated to power conditioning components. The size requirements of these current and future antenna array systems tax traditional wide band component technology, proving the need for further miniaturization.

Prior art microelectronic triodes that operate up to 300 GHz use either a vertical scheme that places many triodes in parallel, or are deposited with a lateral topology utilizing strip line interconnects. Microelectronic triodes utilizing lateral topology are discussed in "Lateral Miniaturized Vacuum Devices", by H. H. Busta, J. E. Pogemiller and M. F. Roth, IEDM, 89-533, IEEE 1989. In triodes with a vertical topology, each cathode has a single field emitter tip. In such a vertical topology, the parallel outputs combine to increase the overall current available from the single field emitter tips of the cathode, by the number of triodes connected in parallel. In triodes utilizing a lateral topology, the individual triodes are joined with strip line interconnects. The strip line interconnects joining the triodes occupy a large portion of the space available in the triode array. Consequently, the power density within the triode array decreases. The lateral topology triodes also require an RF connection using external components in order to deliver the power to the intended load.

It is, therefore, a primary objective of the present invention to create a vacuum microelectronic triode having a lateral topology that creates a high power density and eliminates the need for RF connections, consequently allowing the triode to be further miniaturized.

SUMMARY OF THE INVENTION

In accordance with the present invention, a vacuum microelectronic triode is disclosed. In one preferred embodiment, a substantially cylindrical cathode having a plurality of field emitter, or similar device points or similar device, radially disposed thereon is coaxially positioned within the center of a tubular anode. A plurality of grid or gate electrode rings are coaxially positioned about the cathode, separating the cathode from the anode. The anode has closed ends; thus the anode itself acts as the vacuum envelope for the triode. By having multiple cathode emitting points and multiple gate electrode rings coaxially positioned, the triode creates a large total beam current conducted directly to the anode. The multiple emitter points and large beam current eliminates the need for electrically coupled traditional vertical or lateral topology triodes. The coaxial orientation of the present invention also eliminates the need for traditional RF coupling lines joining the anode, since the anode itself can serve directly as a waveguide or antenna launch. Essentially, the present invention triode can be used in any phased array radar, communication or other data link system that requires a small amplifier with a small signal gain of 10 to 60 dB, moderate RF output power and frequencies from below 2.0 GHz to over 40 GHz that benefits from a direct coupled RF output amplifier.

The gain and power of the triode is only limited by the number of emitter points and gate electrode rings used in its construction. Thus, the present invention can match the performance of large triode devices using lateral topology and strip line interconnects or vertical topology devices that place many triodes in parallel. The result is a highly compact and powerful triode with direct RF coupling capabilities.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
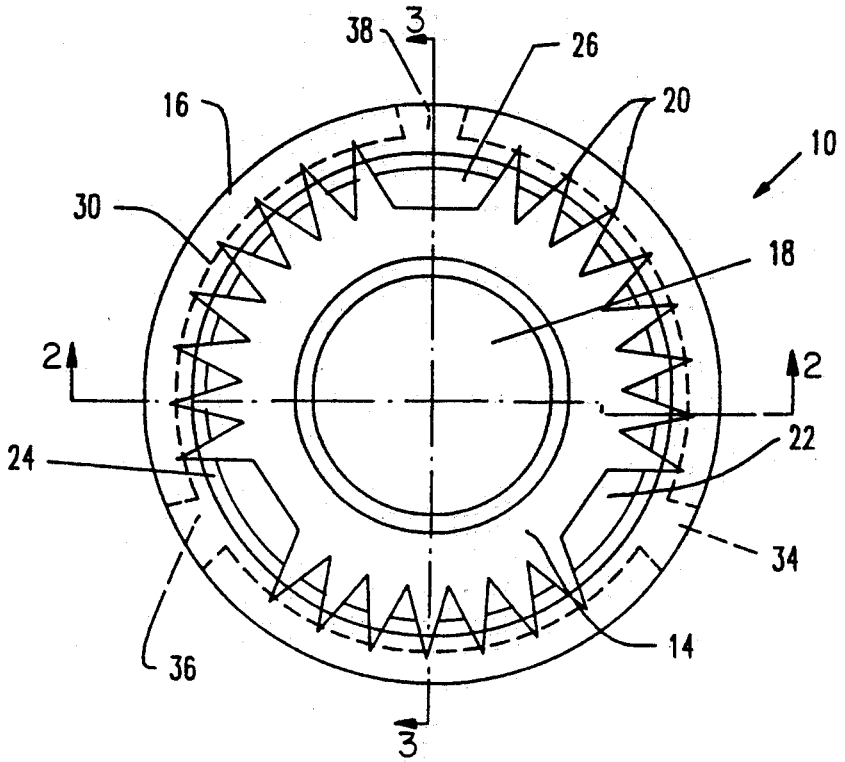
FIG. 1 is a top view of one segment of the cathode, gate electrode structure in accordance with an exemplary embodiment of the present invention.
Figure 2:
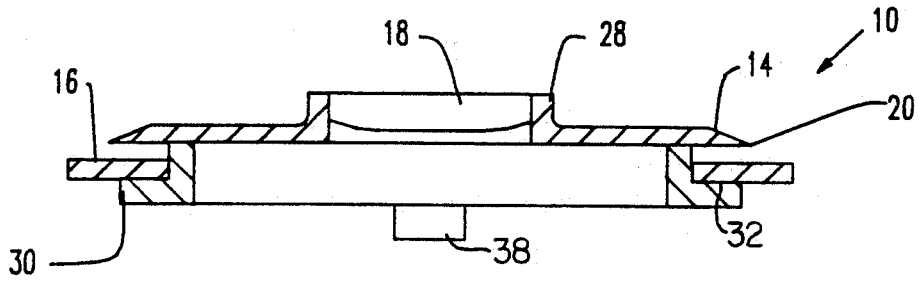
FIG. 2 is a side cross-sectional view of the cathode, gate electrode segment cut across section line 2—2.
Figure 3:
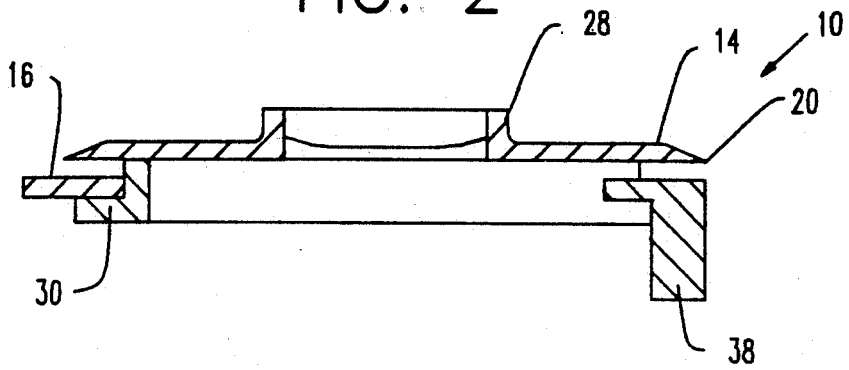
FIG. 3 is a side cross-sectional view of the cathode, gate electrode shown in FIG. 2, cut across section line 3—3.

Referring to FIGS. 1-3, one segment 10 of the cathode-grid electrode composite structure 12 (see FIG. 4) is shown having a cathode emitting ring 14 and a grid or gate electrode ring 16 coaxially positioned about a center aperture 18. The cathode emitting ring 14 has a plurality of radially disposed emitting points 20 symmetrically positioned along its periphery. The emitting points 20 on the cathode emitting ring 14 are substantially planar. The emitters are referred to as lateral emitters and are arranged in a circular configuration with emission directed radially outward. See the above-noted article by H. H. Busta et al. The uniform distribution of the emitting points 20 is disrupted by a plurality of symmetrically distributed gaps 22, 24, 26, through which no emitting points 20 are present. A neck 28 extends upwardly from the cathode ring 14, perpendicular to the plane of the points 20, surrounding the periphery of the center aperture 18. The cathode ring 14 and emitting points 20 are formed from a suitable conductive material.

The cathode ring 14 is positioned atop a coaxial annular support member 30. The support member 30 is formed from a suitable dielectric material. The support member 30 has a peripheral flange 32 formed along its outer diameter edge, on which the gate electrode ring 16 rests. The gate electrode ring 16 is mostly planar; however, connecting members 34, 36, 38 extend downwardly from the gate electrode ring 16 extending beyond the bottom surface 40 of the annular support member 30. The position of the connecting members 34, 36, 38 correspond in position to the gaps 22, 24, 26, formed in the cathode ring 14 such that each connecting member 34, 36, 38 passes through a corresponding gap 22, 24, 26 when stacked atop one another. The gate electrode 16 and connecting members 34, 36, 38 are formed from a suitable conductive material.

Figure 4:
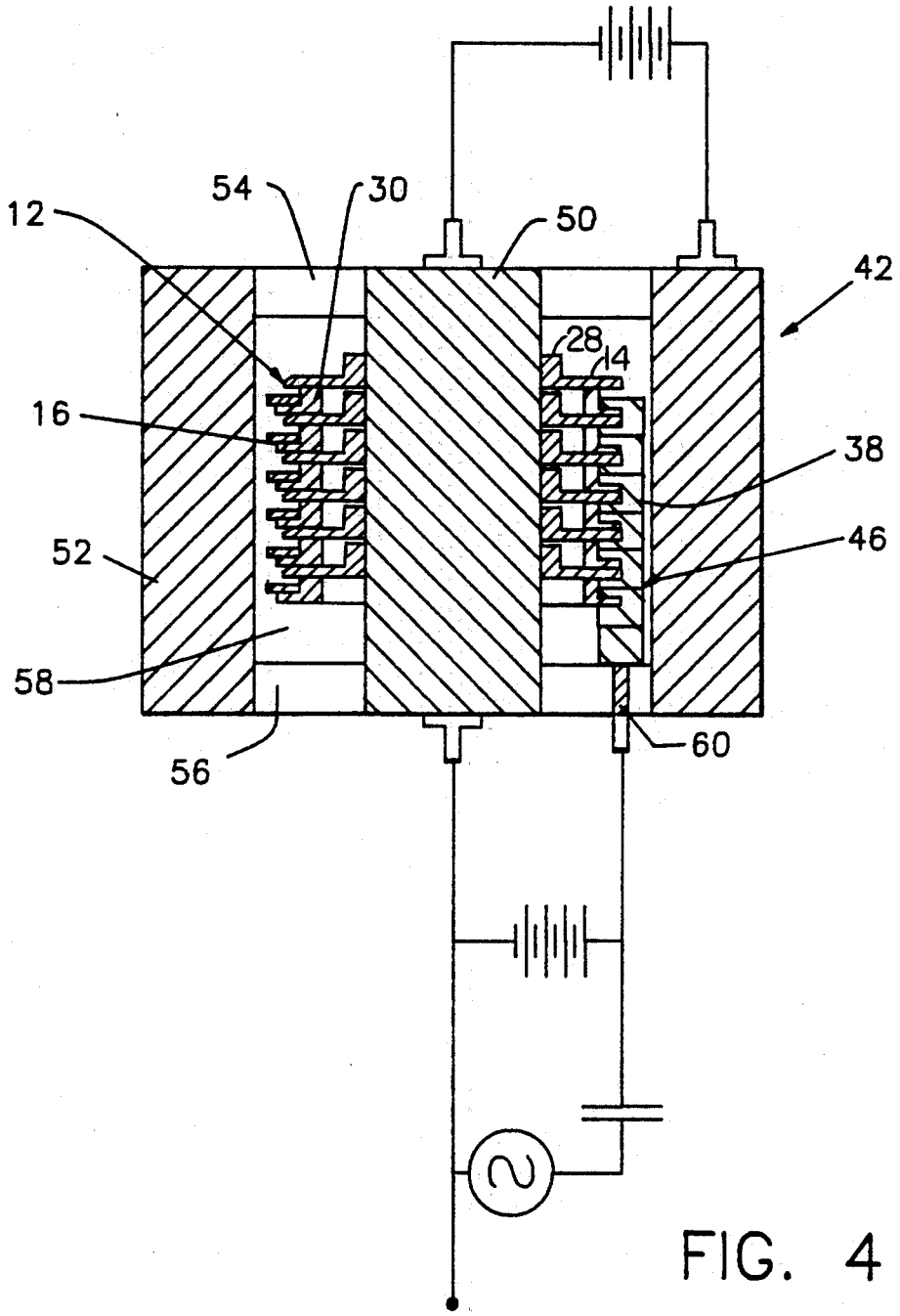
FIG. 4 is a side cross-sectional view of a triode in accordance with the exemplary embodiment of the present invention.

Referring to FIG. 4, the cathode-gate electrode composite structure 12 comprising seven stacked segments 10 is shown as part of a triode 42. As is shown, the segments 10 are stacked coaxially atop one another. The neck 28, support member 30 and connecting members 34, 36, 38 are so proportioned so the neck 28 of one segment contacts the bottom surface of the cathode emitting ring 14 of an adjacent segment at the same instant the support member 30 and the connecting members 34, 36, 38 abut against the cathode emitting ring 14 and gate electrode ring 16, respectfully. The juxtaposition of adjacent connecting members 34, 36, 38 and gate electrode rings 16 create a continuous electrical pathway 46 across each of the segments 10, electrically coupling each of the gate electrode rings 16.

The coaxial alignment of the center aperture 18 of each segment creates a cylindrical hollow through which a cathode 50 is passed. The cathode 50 contacts the walls of the cylindrical hollow; consequently, the cathode ring 14 becomes part of the cathode 50 and electrons are emitted from the plurality of radially disposed emitter points 20. It should be understood that although the cathode 50 is not unistructurally formed as part of the cathode emitting rings 14 in the shown embodiment, the cathode 50 and the cathode emitting rings 14 can be integrally formed.

Alternately positioned between the cathode emitting rings 14 are the gate electrode rings 16. Since the gate electrode rings 16 have a larger diameter than do the coaxially positioned cathode emitting rings 14, the gate electrode rings 16 extend beyond the cathode emitting rings 14, separating the cathode emitting points 20 from the anode 52. Consequently, during operation, the multiple layers of gate electrode rings 16 create a three-dimensional field around the multiple layers of cathode emitting points 20 controlling the switching operations of the triode 42. The gain and power of the triode is limited only by the number of emitter points and number of gate electrode rings 16 alternately stacked. The multiple emitting points 20 all depend from a common cathode 50, thus creating a large total beam current, to be directed toward an anode. Coaxially positioned around the cathode-gate electrode composite structure 12 is a cylindrically shaped anode 52. The ends of the cylindrical anode 52 are closed between the anode 52 and the cathode 50 by annular insulating members 54, 56. The enclosed space 58 created within the cylindrical anode 52 is evacuated; thus, the anode 52 creates a vacuum envelope about the cathode 50 and the cathode-gate electrode composite structure 12.

Since the cylindrical anode 52 acts as the vacuum envelope for the triode 42, the anode 52 itself can now be applied to a larger electronic component without the need for RF connections. For example, the cylindrical anode 52 can be used directly as a waveguide, coaxial transmission line or antenna launching stub. Consequently, the direct RF coupling to a transmission line, antenna or excitation cavity load is achieved through the cylindrical anode 52 acting as a waveguide launch. The elimination of external RF connections increases the system efficiency of the triode 42 by increasing power density, and decreases both assembly time and per unit cost.

Figure 5:
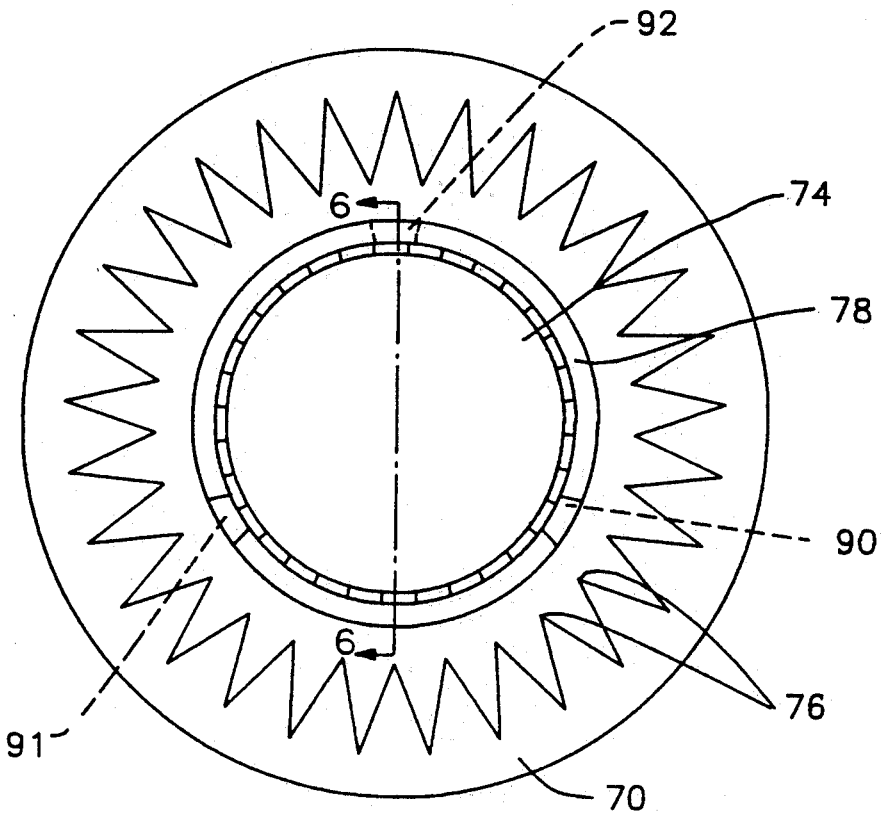
FIG. 5 is a top view of one segment of the cathode, gate electrode structure in accordance with an alternative embodiment of the invention.
Figure 6:
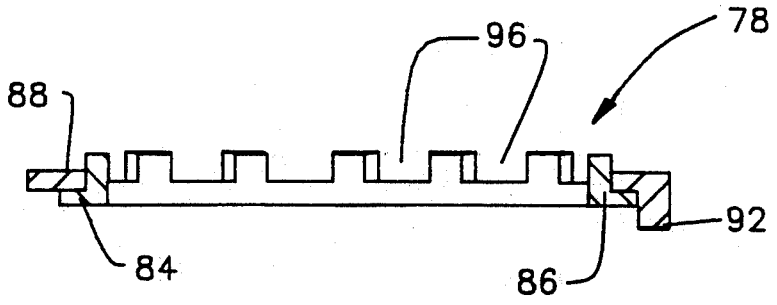
FIG. 6 is a side cross-sectional view of the cathode, gate electrode segment shown in FIG. 5, cut across section line 6—6.
Figure 7:
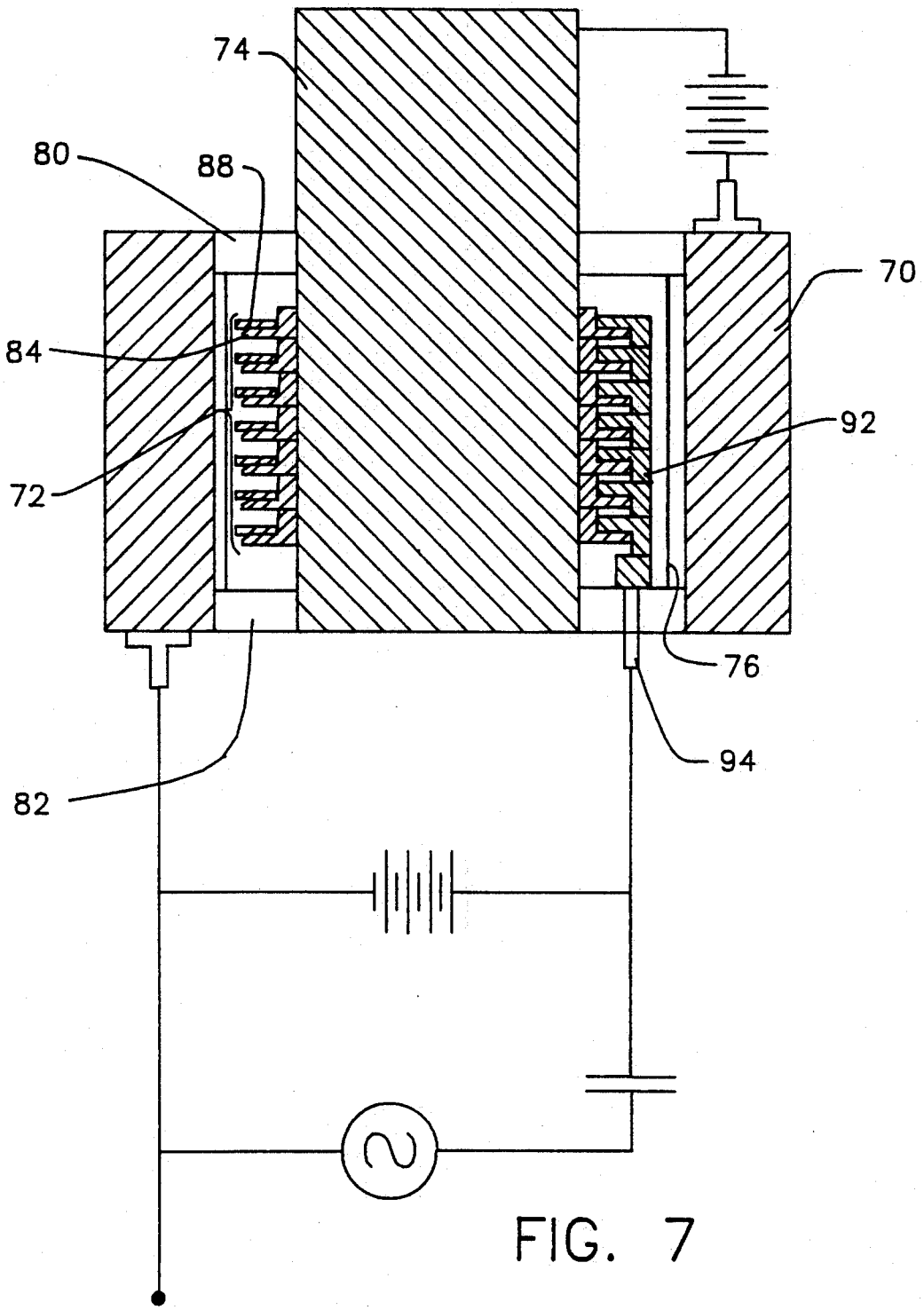
FIG. 7 is a side cross-sectional view of a triode in accordance with an alternate exemplary embodiment of the present invention.

Referring to FIGS. 5–7, an alternate embodiment of the present invention is shown wherein the cathode 70 forms the vacuum envelope surrounding a composite gate electrode 72 and an anode 74. In this embodiment, the cylindrical cathode 70 has points 76 inwardly disposed. Coaxially positioned within the cylindrical cathode 70 is an anode 74. The anode 74 is surrounded by a plurality of gate electrode segments 78 that stack one atop another to create the composite grid electrode 72. Annular insulating members 80, 82 seal the ends of the vacuum envelope between the cylindrical cathode 70 and the anode 74.

The gate electrode segments 78 each consist of an annular support member 84 having a peripheral flange 86 formed along its outer edge. Resting in the flange 86 is the gate electrode ring 88, formed from a conductive material. The gate electrode ring 88 is essentially planar, except a plurality of connecting members 90, 91, 92 extend downwardly from each gate electrode ring 88. The connecting members 90, 91, 92 abut against the gate electrode ring 88 of a below lying gate electrode segment as the segments are stacked atop one another. The abutment of gate electrode rings 88 and connecting members 90, 91, 92, electrically couple all the gate electrode rings 88. An electrical connector 94 extends into the vacuum envelope through the insulating member 82, connecting the lowest gate electrode ring 88 to source of electrical potential.

The annular support member 84, supporting each gate electrode ring 88, is formed from a dielectric material. The annular support members 84 insulate gate electrode ring 88 from the anode 74 and space the gate electrode rings 88 along the length of the anode 74. The annular support member 84 is formed with a plurality of orifices 96 positioned above the gate electrode ring 88. The orifices permit the passage of electrons from the cathode 70 to the anode 74 through the dielectric material of the annular support member 84.

In the embodiment illustrated, the anode 74 extends out of the vacuum envelope and is longer than the cathode 70. The portion of the anode 74 extending beyond the cathode 74 serves directly as a launching stub for an antenna or the like without the need for external RF connections.

The cathode-gate electrode segments 10 of the embodiment shown in FIGS. 1–4 and the gate electrode segments 78 of the embodiment of FIGS. 5–7 have a high degree of detail and can be manufactured at very small dimensions. As such, the manufacture of such structures is best accomplished utilizing VLSI integrated circuit and/or micro-machining techniques, where the formation of such three-dimensional structures is well within the limitations of the art. Similarly, the anode and cathode of the present invention triode can also be manufactured utilizing VLSI integrated circuit techniques and may be formed simultaneously with the gate electrode structures. For example, the anode, gate electrode and cathode can be built up one layer at a time utilizing thick or thin film technology. Such layers can be etched in the appropriate configurations and superimposed atop one another creating a composite structure. The techniques needed to create such a structure are disclosed in "The Application of Thin-Film Field-Emission Cathodes to Electronic Tubes", by I. Brodie and C. A. Spindt, Applied Surface Science, vol. 2, pgs. 149-163, 1979.

It will be understood that the embodiments described herein are merely exemplary and that a person skilled in the art may make variations and modifications without departing from the spirit and scope of the invention. More specifically, it should be recognized that the geometric orientation and number of emitter points radially disposed on the cathode can be infinitely varied. Similarly, the dimensions and number of gate-electrode rings and emitter points can be varied to match a desired space and operational requirement for a triode application. All such variations and modifications should be obvious, in view of the present invention disclosure, and are intended to be included within the scope of the invention as defined in the appended claims. In addition, electronic tube configurations with more than one grid or gate electrode ring, such as tetrodes, pentodes, etc., are also intended to be within the scope of this application. The above mentioned tubes being simply an extension of the triode by the placement of one or more additional gate electrode rings between the cathode emitters and the anode.

We claim:

1. A triode comprising:

a substantially cylindrical cathode member having a plurality of emitting points radially disposed thereon, said plurality of emitting points being arranged in a plurality of substantially parallel planes on said cathode member; and a plurality of conductive rings positioned coaxially around said cathode member, wherein one of said conductive rings is disposed between each of said parallel planes of emitting points, each of said plurality of conductive rings including a conductive element that traverses the plane of emitting points separating the conductive ring from an adjacent conductive ring, wherein said conductive element contacts the adjacent conductive ring in an electrically conductive manner; and a substantially tubular anode member coaxially positioned around said conductive rings, said anode member having closed ends enveloping said conductive rings and a corresponding portion of said cathode member in a vacuum.

2. The triode of claim 1, wherein each of said conductive rings is electrically insulated from said cathode member by an insulating means.

3. The triode of claim 2, wherein said emitting points are radially disposed along the peripheries of a plurality of substantially parallel annular flanges.

4. The triode of claim 3, wherein said conductive rings are alternately positioned between said plurality of annular flanges.

5. The triode of claim 4, wherein said cylindrical cathode member has a longitudinal axis and the radius from the longitudinal axis to the periphery of said conductive rings is greater than the radius from said axis to said emitting points.

6. The triode of claim 5, wherein insulating means is an annular dielectric member attached to said cathode member.

7. The triode of claim 6, wherein at least one gap is disposed on each of said flanges positioned between two of said conductive rings, said gap providing an opening through each of said flanges through which said conductive element passes thereby enabling each said conductive element to electrically interconnect said conductive rings.

8. A triode comprising:

a substantially cylindrical cathode-gate electrode structure having alternately and coaxially stacked planar cathode members and planar gate electrode members, said cathode members and said gate electrode members being electrically insulated from each other by an insulating means; and an anode structure surrounding said cathode-gate electrode structure enclosing said cathode-gate electrode structure in a vacuum.

9. The triode of claim 8, wherein said stacked planar cathode members and planar gate electrode members are substantially parallel.

10. The triode of claim 9, wherein said insulating means is a dielectric member positioned between each cathode member and each gate electrode member.

11. The triode of claim 10, wherein said cathode members include a plurality of emitting points radially disposed thereon.

12. The triode of claim 11, wherein said gate electrode members radially extend between said emitting points and said anode structure.

13. A triode comprising:

a plurality of substantially planar annular conductive members coaxially positioned in generally parallel planes around a substantially cylindrical anode member, each of said conductive members being electrically interconnected and insulated from said anode member by an insulating means; and a substantially tubular cathode member coaxially positioned around said conductive members, said cathode member having closed ends enveloping said annular members and a corresponding portion of said anode member in a vacuum.

14. The triode of claim 13, wherein a plurality of inwardly extending emitting points are symmetrically disposed along the internal wall of said tubular cathode member.

15. The triode of claim 14, wherein said insulating means is an annular dielectric member retaining said annular conductive member along a peripheral edge.

16. The triode of claim 15, wherein each of said conductive members includes a conductive element that extends toward and engages an adjacent conductive member, thereby electrically interconnecting each of said conductive members.

17. The triode of claim 16, wherein said annular dielectric members are concentrically stacked against one another around said anode member.

18. The triode of claim 17, wherein said dielectric members have a plurality of orifices formed therethrough for the passage of electrons from said cathode member to said anode member.

19. The triode of claim 18, wherein said anode member extends out beyond the vacuum envelope created within said cathode member.

* * * * *